US007694964B2

(12) United States Patent
Kawasaki et al.

(10) Patent No.: US 7,694,964 B2
(45) Date of Patent: Apr. 13, 2010

(54) SHEET MATERIAL INFORMATION DETECTION APPARATUS, SHEET MATERIAL PROCESSING APPARATUS, AND SHEET MATERIAL PROCESSING METHOD

(75) Inventors: Takehiko Kawasaki, Kamakura (JP); Norio Kaneko, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 11/769,081

(22) Filed: Jun. 27, 2007

(65) Prior Publication Data

US 2008/0001348 A1 Jan. 3, 2008

(30) Foreign Application Priority Data

Jun. 28, 2006 (JP) ..... 2006-178770

(51) Int. Cl.
*B65H 7/12* (2006.01)

(52) U.S. Cl. ..... 271/263; 271/262; 271/265.04

(58) Field of Classification Search ..... 271/262, 271/263, 265.04; 73/159
See application file for complete search history.

(56) References Cited

U.S. PATENT DOCUMENTS

| | | | | |
|---|---|---|---|---|
| 4,777,729 | A * | 10/1988 | Hausler | 33/501.03 |
| 4,879,513 | A * | 11/1989 | Spiegel et al. | 324/207.24 |
| 5,934,140 | A | 8/1999 | Jackson et al. | |
| 7,152,861 | B2 | 12/2006 | Kawasaki | 271/262 |
| 7,239,817 | B2 | 7/2007 | Kaneko et al. | 399/45 |
| 7,296,795 | B2 | 11/2007 | Kawasaki | 271/262 |
| 7,304,291 | B2 | 12/2007 | Kawasaki et al. | 250/221 |
| 7,426,062 | B2 * | 9/2008 | Nojiri et al. | 358/3.24 |
| 2003/0141653 | A1 * | 7/2003 | Kumamoto et al. | 271/262 |
| 2004/0008365 | A1 | 1/2004 | Hobbs | |
| 2006/0022400 | A1 | 2/2006 | Kawasaki et al. | 271/227 |
| 2006/0275045 | A1 | 12/2006 | Kawasaki et al. | 399/45 |
| 2007/0036567 | A1 | 2/2007 | Kawasaki et al. | 399/45 |
| 2007/0200568 | A1 | 8/2007 | Shioda et al. | 324/640 |

FOREIGN PATENT DOCUMENTS

| | | |
|---|---|---|
| JP | 10-152245 | 6/1998 |
| JP | 2004-038983 | 2/2004 |
| JP | 2005-024550 | 1/2005 |

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

An external force application unit is allowed to impact on a sheet material, and an external force detection unit detects an impact force through the sheet material. Further, there is provided a push-in sensing unit for detecting abnormality of the sheet material entering a space between the external force application unit and the external force detection unit. When the push-in sensing unit detects the abnormality, a control circuit operates a motor to rotate a cam, thereby moving the external force application unit to be retracted in a direction in which the external force application unit is moved away from an entering position of the sheet material.

3 Claims, 8 Drawing Sheets

SHEET MATERIAL INFORMATION DETECTION APPARATUS, SHEET MATERIAL PROCESSING APPARATUS, AND SHEET MATERIAL PROCESSING METHOD

BACKGROUND OF THE INVENTION

1. Field of the Invention

The present invention relates to a sheet material information detection apparatus for detecting sheet material information by applying an external force to a sheet material, and more particularly, to a control in a case where there occurs abnormality with the sheet material entering a detection unit.

2. Description of the Related Art

In recent years, in sheet material processing apparatuses, typified by image forming apparatuses (such as Laser Beam Printer, copying machine, and ink jet printer), there is diversification of types of sheet materials to be processed. There is also diversification of users and use environment of the sheet material processing apparatus. Only with regard to the image forming apparatus, for the sheet materials of the diversified types, there is an increase in demand for higher quality (higher image quality, higher processing speed, and the like). On the other hand, with the diversification of sheet materials and diversification of processing contents, the number of items to be set by the user becomes enormous, thereby making it difficult to set an optimum processing condition. Therefore, a technique, in which various sensors are arranged in the sheet material processing apparatus to automatically identify sheet material information including a size, a thickness, and a quality of the sheet material, and automatically set an optimum processing condition, is put into practical use in some cases.

Japanese Patent Application Laid-Open No. 2005-024550 discloses a sheet material information detection apparatus having a structure in which an impact application member is allowed to impact a sheet material, and an impact through the sheet material is detected by an external force detection unit using a piezoelectric element. In this case, a voltage output of the piezoelectric element deformed by receiving the impact is detected to determine a peak value of the detected voltage output, thereby specifying a type of the sheet material. The piezoelectric element is sandwiched between an impact receiving member and a buffer member, and the impact received by the impact receiving member through the sheet material exerts a compression force on an entire surface of the piezoelectric element.

Japanese Patent Application Laid-Open No. 2004-038983 discloses a system which makes a database of various pieces of sheet material information, the database being shared by a plurality of printers. In this case, the sheet material information include texture, glossiness, ink absorbency, luminance, gross, color reflection, color depth, graininess, whiteness, humidity, heat loss, adhesiveness, and bonding property. When the sheet material is designated, a requisite piece of sheet material information is taken out from the database to a selected printer. Processing setting optimized based on the sheet material information is automatically set for the printer.

Japanese Patent Application Laid-Open No. H10-152245 discloses a sheet material information detection apparatus arranged in a transport path for a sheet material in an image forming apparatus. In this case, electrode terminals are brought into contact with upper and lower surfaces of the sheet material to measure resistivity and a moisture amount of the sheet material.

The sheet material information detection apparatus as disclosed in Japanese Patent Application Laid-Open No. 2005-024550 detects the sheet material by sandwiching a single passing sheet material in a thickness direction. Accordingly, when the folded sheet material or the stacked sheet materials enter therein, normal detection cannot be performed.

Further, a detection mechanism including a mechanical operation portion is precisely assembled by using lightweight components. Accordingly, there is a risk of the detection mechanism receiving deformation or damage when the sheet material impacts thereon at high speed or the stacked sheet materials are strongly caught therein.

Further, in the sheet material information detection apparatus as disclosed in Japanese Patent Application Laid-Open No. 2005-024550, the impact application member and the external force detection unit are arranged in positions which sandwich a transport height position of the sheet material so as to be opposed to each other, and a distance therebetween also serves as the transport path for the sheet material. Therefore, according to a state of the sheet material or transport conditions thereof, there may be a case where the folded sheet material clogs (so-called sheet clogging (also referred to as jam)) between the impact application member and the external force detection unit. In this case, the sheet material cannot easily be removed from an upstream side or from a downstream side. When the sheet material is forcedly drawn out, there is a risk in that not only the sheet material itself may be broken, but also a member coming into contact with the sheet material (including the sheet material information detection apparatus) may be broken, or damaged. There is a risk in that while the breakage is not caused, at least one of the impact application member and the external force detection unit is strained, thereby causing the impact application member and the external force detection unit to go out of alignment.

In particular, a high-speed image forming apparatus has a high transport speed for the sheet material. Therefore, when the sheet material clogs in the transport path, the folded sheet material exerts a substantial force on peripheral contact sections, so a risk of peripheral members being broken increases.

The conventional examples disclosed in Japanese Patent Application Laid-Open No. 2004-038983 and Japanese Patent Application Laid-Open No. H10-152245 include no countermeasure such as prevention of breakage in a case where there occurs abnormality such as the clogging of the sheet material.

SUMMARY OF THE INVENTION

It is an object of the present invention to provide a sheet material information detection apparatus capable of avoiding breakage or damage of a detection mechanism of the sheet material information detection apparatus even in a case where there is abnormality of a sheet material to be supplied.

According to the present invention, there is provided, a sheet material information detection apparatus including: an external force application unit for applying an external force to a sheet material; an external force detection unit for detecting the external force applied by the external force application unit; an abnormality detection unit for detecting abnormality of the sheet material entering a space between the external force application unit and the external force detection unit; and a retraction unit for allowing at least one of the external force application unit and the external force detection unit to retract in a direction in which the at least one of the external force application unit and the external force detection unit is moved away from one of the sheet material and a transport path for the sheet material in a case where the abnormality detection unit detects the abnormality.

The sheet material information detection apparatus according to the present invention has a structure in which, when the abnormality detection unit detects the abnormality of the sheet material, the retraction unit allows at least one of the external force application unit and the external force detection unit to be retracted to a position where the at least one of the external force application unit and the external force detection unit is less prone to suffer damage or impairment by the abnormal sheet material.

Accordingly, even in a case where there is abnormality such as clogging of a sheet material (hereinafter, referred as "sheet clogging") at the time of transporting the sheet material, a trouble such as breakage of the sheet material information detection apparatus or peripheral members is avoided. Therefore, an appropriate sheet material processing can be performed. Due to the retraction, a distance between the external force application unit and the external force detection unit is enlarged, so the sheet material with the abnormality can easily be removed. When removing the sheet material, the external force application unit and the external force detection unit are not strained, so a risk of the sheet material being broken is reduced.

Further features of the present invention will become apparent from the following description of exemplary embodiments with reference to the attached drawings.

DESCRIPTION OF THE EMBODIMENTS

Figure 1:
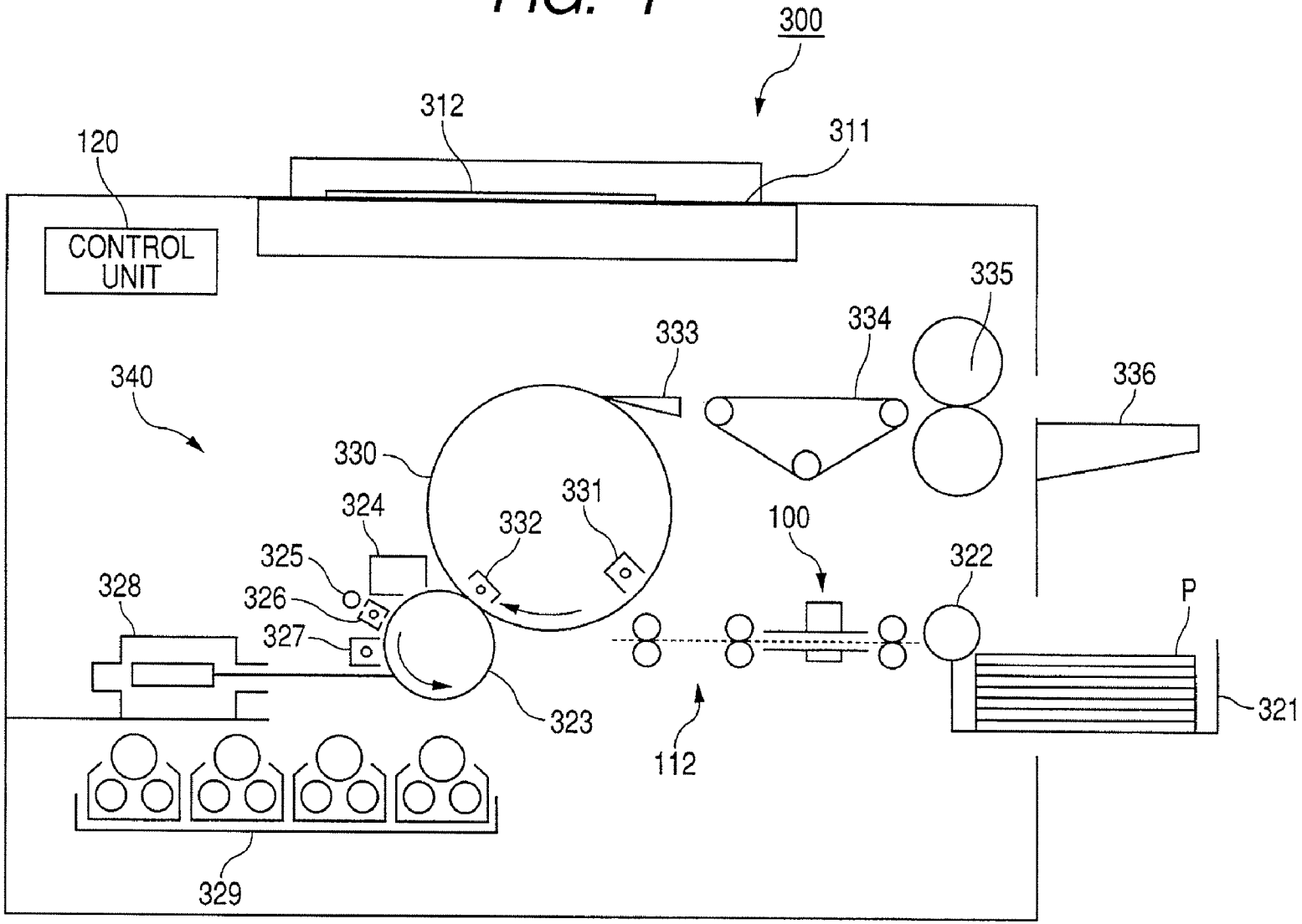
FIG. 1 is an explanatory diagram of a structure of an image forming apparatus.

Hereinafter, a detailed description will be made of a sheet material information detection apparatus according to an embodiment of the present invention with reference to the drawings. The sheet material information detection apparatus according to the present invention is not limited to a limitative structure according to embodiments described below. As long as an external force application unit is received by an external force receiving member through an intermediation of a sheet material, another embodiment may be achieved, in which a part or a whole of structures of the embodiments may be replaced with an alternative structure.

In this embodiment, a description is made of an example in which the sheet material information detection apparatus is mounted on an electrostatic image forming apparatus. However, the sheet material information detection apparatus may be mounted on an ink jet image forming apparatus, various printing devices, or various sheet material processing apparatus such as a sheet material processing device, a sheet material stacking devices, or a sorter.

Note that, the structure, operation, control, operation principle of the sheet material information detection apparatus, signal processing, and the like of the image forming apparatus disclosed in each of the patent documents described above will not be illustrated in the drawings and descriptions thereof will also be omitted for avoiding redundancy.

Embodiment 1

Figure 2:
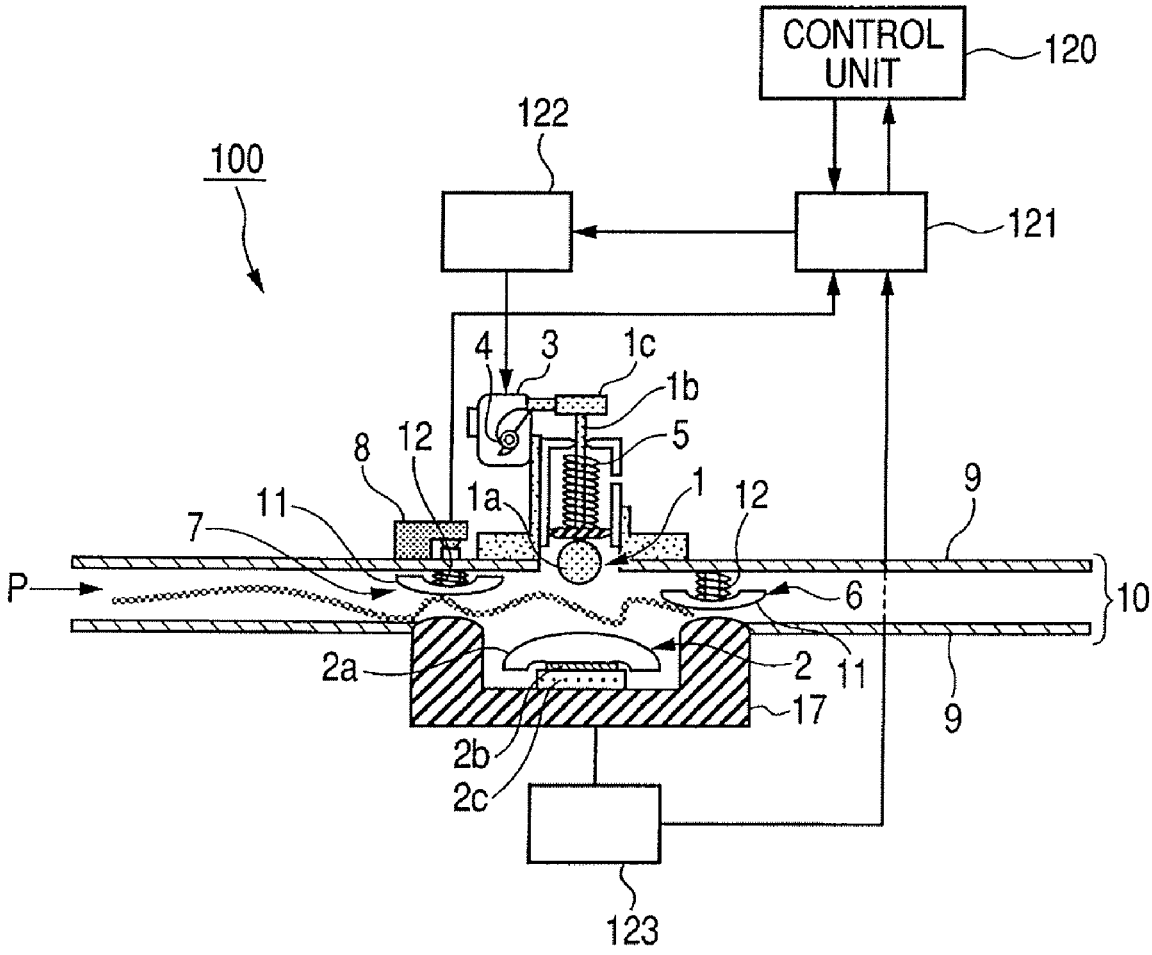
FIG. 2 is an explanatory diagram of a structure of a sheet material information detection apparatus according to Embodiment 1 of the present invention.
Figure 3B:
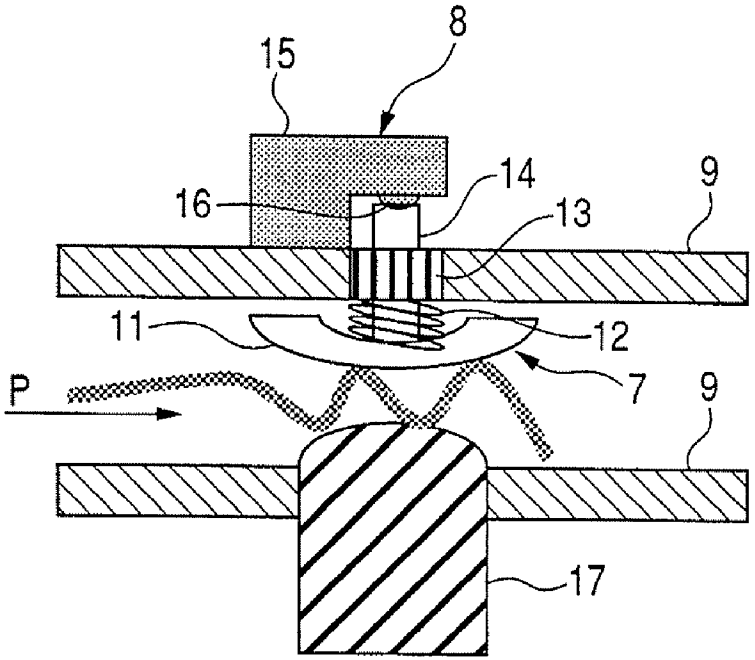
FIGS. 3A and 3B are explanatory diagrams of an operation of an abnormality sensing unit.
Figure 3A:
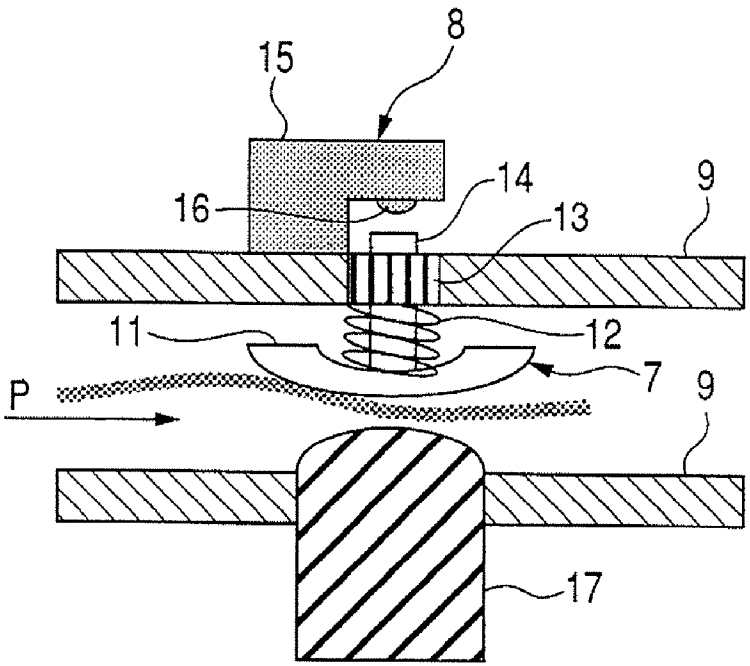
Figure 4:
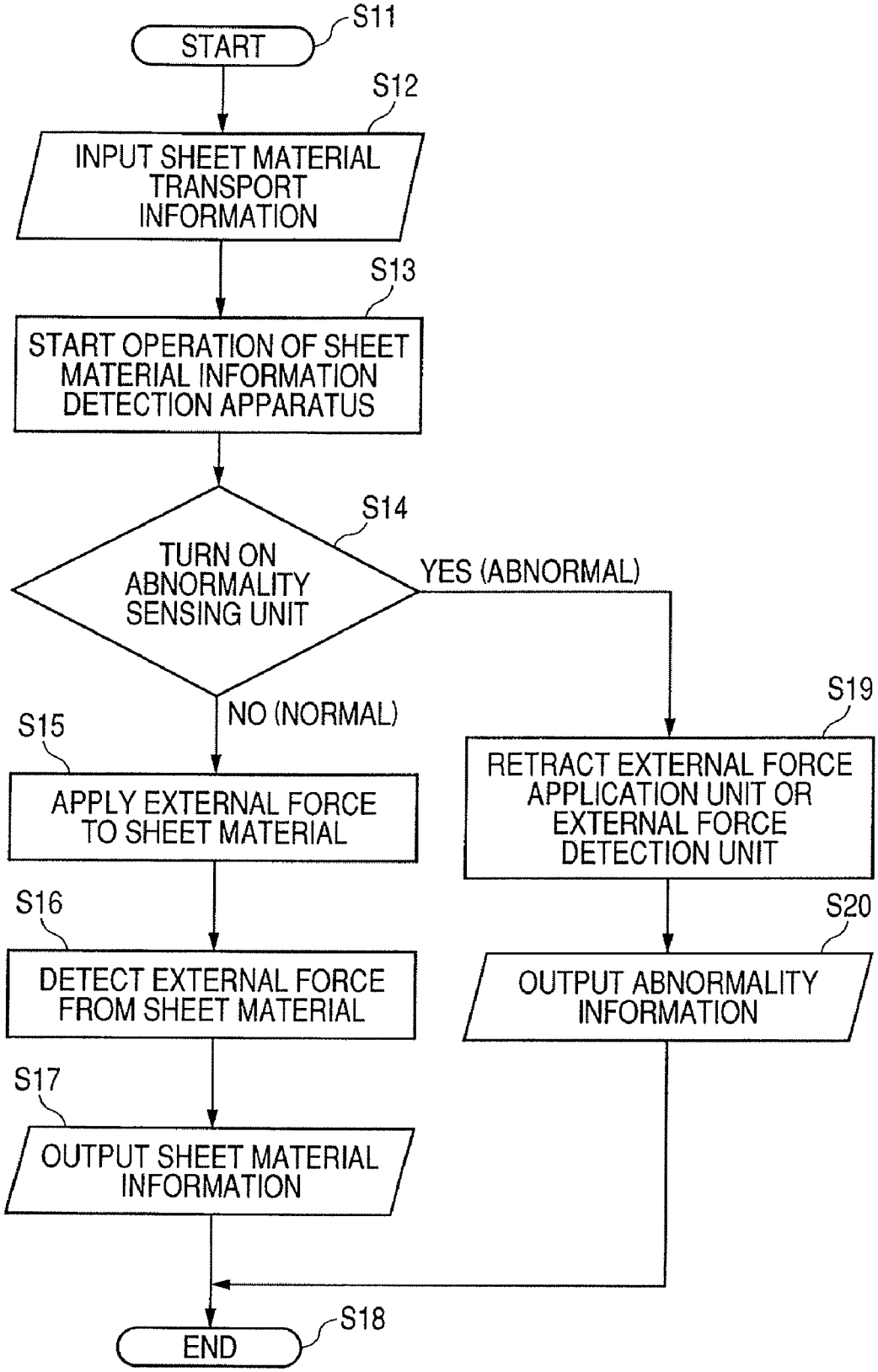
FIG. 4 is a flow chart for explaining an operation of the sheet material information detection apparatus.

FIG. 1 is an explanatory diagram of a structure of an image forming apparatus. FIG. 2 is an explanatory diagram of a structure of a sheet material information detection apparatus according to Embodiment 1 of the present invention. FIGS. 3A and 3B are explanatory diagrams of an operation of an abnormality sensing unit. FIG. 4 is a flow chart for illustrating an operation of the sheet material information detection apparatus. FIG. 3A illustrates a case where a normal sheet enters the abnormality sensing unit. FIG. 3B illustrates a case where a folded sheet enters the abnormality sensing unit.

As illustrated in FIG. 1, the image forming apparatus 300 is a color copying machine for performing image formation on a sheet material P by an image formation process unit 340. A reading unit 311 reads image information of a color original 312. The read information is converted into different color signals corresponding to four colors of toner, which are cyan, magenta, yellow, and black.

On the other hand, the sheet material P accommodated in a cassette 321 is sent to a transporting unit 112 by a transmission roller 322. In a position adjacent to the transporting unit 112, there is provided the sheet material information detection apparatus 100. The sheet material information detection apparatus 100 is arranged so as to sandwich, from above and below, a transporting position of the sheet material P, being passed from the transmission roller 322 to the transporting unit 112. The sheet material information detection apparatus 100 detects sheet material information (mechanical property) of the sheet material P passing through the transporting position.

A control unit 120 identifies the sheet material information on the sheet material P detected by the sheet material information detection apparatus 100 before the image formation is performed by the image formation process unit 340, and sets an optimum transporting condition, transfer condition, fixing condition, or the like.

Next, the sheet material P is sent to a drum 330. A peripheral surface of the drum 330 is provided with a dielectric sheet. The sheet material P is sucked and carried on by a surface of the drum 330 charged by a suction corona discharger 331. After that, due to an action of the suction corona discharger 332, a toner image on a photosensitive drum 323 is transferred to a sheet material P.

A surface of the photosensitive drum 323 is cleaned by a blade cleaner 324. A pre-exposure lamp 325 and a front static eliminator 326 eliminate an effect remaining on a photosensitive member surface layer due to the last image formation. Next, a surface of the photosensitive drum 323 is uniformly charged by a primary charger 327. A charge amount at this time is determined based on the sheet material information on the sheet material P.

A laser beam scanner 328 scans the surface of the photosensitive drum 323 to form an electrostatic latent image based on the different color signals of the color original 312 obtained by reading. A developing device 329 includes developing units of four colors, which are cyan, magenta, yellow, and black. The developing units corresponding to respective colors successively move to a position directly below the photosensitive drum 323 to develop the latent image on the photosensitive drum 323 to a toner image.

The sheet material P is sucked and carried on the drum 330 until the toner image of four colors is successively transferred. After that, the sheet material P is separated from the drum 330 by an action of a separation claw 333. The separated sheet material P is sent to a heating roller fixing device 335 by a conveyor belt 334 and heat and pressure are applied thereto, so a toner image is fixed onto a surface of the sheet material P. A fixing temperature at this time is determined based on sheet material information on the sheet material P.

The sheet material P after completion of the fixation is delivered onto a tray 336. Toner remaining on the surface of the photosensitive drum 323 after completion of the transfer is cleaned by the blade cleaner 324, and a process advances to a next image formation cycle.

As illustrated in FIG. 2, the sheet material information detection apparatus 100 according to Embodiment 1 of the present invention detects, by a push-in sensing unit 8, a state, where the sheet material P which is transported causes the sheet clogging. An external force application unit 1 is upwardly retracted by a motor 3 and a cam 4. A control circuit 121 for the sheet material information detection apparatus 100 controls and drives the motor 3, and determines abnormality by using the push-in sensing unit 8. The control unit 120 of the image forming apparatus 300 (FIG. 1) controls the control circuit 121 to receive sheet material information and performs processing of the sheet material information or abnormality information as required.

The sheet material information detection apparatus 100 has a structure in which an external force detection unit 2 detects an external force, which is applied by the external force application section 1 for applying an external force to the sheet material P, through the sheet material P. A converting unit (charge amplifier) 123 converts a change in volume of a pressure-sensitive element 2*b* due to deformation thereof into a change in voltage signal. The control circuit 121 detects a peak value of the voltage signal output from the converting unit 123 to take out the sheet material information. The sheet material information corresponds to a peak value of an impact force detected through the sheet material P, and reflects mechanical property and a moisture amount of the sheet material P.

The external force application unit 1 includes an end portion (side coming into contact with the sheet material P) 1*a*, a shaft 1*b*, and a pin 1*c* coming into contact with the cam 4. The end section 1*a* is made of SUS 304, that is, a stainless steel material, and has a contact surface with respect to the sheet material P, which is subjected to spherical working so as to have a radius of 20 mm. A mass of the external force application unit 1 as a whole is 4 g.

A driving unit for driving the external force application unit 1 includes the motor 3, the cam 4, a spring 5 as an acceleration unit. Used as the motor 3 is a stepping motor. The cam 4 is rotated by a requisite angle from a stop position and is returned again to the stop position. At the stop position, the rotation of the cam 4 is started, external application is then performed twice, and the cam 4 then returns again to the stop position (retraction position), thereby completing one cycle. Time required for one cycle is 0.2 seconds. An interval between two times of external force applications is 0.1 seconds.

One cycle is started after a predetermined time has elapsed from reception of a signal of a sheet material passage detection sensor (not shown). The cam 4 lifts the external force application unit 1 against a force of the spring 5 and releases the external force application unit 1. The cam 4 compresses and releases the spring 5 twice in a process of one rotation, and strikes out the external force application unit 1 toward the sheet material P.

The normal stop position of the cam 4 is set to a position before a position where the cam 4 allows the spring 5 to be compressed to a maximum degree during the rotation process of the cam 4. When the cam 4 is at the stop position, the external force application unit 1 is spaced apart from the sheet material P to a maximum degree. The stop position is the same as the retraction position. The external force application unit 1 impacts on the sheet material P at a predetermined speed corresponding to a height to which the external force application unit 1 is lifted by the cam 4, thereby performing external force application. The cam 4, the spring 5, and the external force application unit 1 are designed such that an impact speed in a first external force application is 0.5 m/sec, and an impact speed in a second external force application is 0.2 m/sec.

During one rotation of the cam 4 by the motor 3, there is effected a process of temporarily stopping the rotation. This is effected to wait for unnecessary vibration of the spring 5 and the external force application unit 1 involved in the striking and impacting of the external force application unit 1 to attenuate. The temporary stop of the rotation of the cam 4 is performed when the cam 4 is in a positional range where the cam 4 allows the spring 5 to be compressed.

The external force detection unit 2 is placed so as to be opposed to the external force application unit 1 through the intermediation of the sheet material P. The external force detection unit 2 includes an impact receiving unit 2*a* and a reinforcing member 2*c*, and the pressure-sensitive element 2*b* integrally sandwiched therebetween. The impact receiving unit 2*a* receives impact of the external force application unit 1 through the sheet material P and exerts a compression force to the entire surface of the pressure-sensitive element 2*b*. The reinforcing member 2*c* reinforces the pressure-sensitive element 2*b* to suppress deformation other than compression, in particular, bending deformation of the pressure-sensitive element 2*b*.

The reinforcing member 2 fixing the impact receiving unit 2*a* and the pressure-sensitive element 2*b* is bonded to a sheet material support unit 17. For the pressure-sensitive element 2*b*, lead zirconate titanate (PZT) ceramics is used, for the reinforcing member 2*c*, SUS 304 is used, and the pressure-sensitive element 2*b* and the reinforcing member 2*c* are bonded to each other by an epoxy resin.

The sheet material information detection apparatus 100 is provided with a sheet material presser 7 on an inlet side and a sheet material presser 6 on an outlet side, the sheet material presser 7 and the sheet material presser 6 sandwiching the external force detection unit 2 therebetween. The sheet material pressers 6 and 7 suppress flapping of the sheet material transported between transport guides 9, thereby reproducing relative heights of the sheet material P and the external force detection unit 2 at the time of impacting of the external force application unit 1 to be constant. The sheet material pressers 6 and 7 support displacement members 11, that is, metal members which are subjected to curved surface working so as to dissipate impact shock due to the impact caused through transportation of the sheet material P, in a vertically movable manner, and allow the displacement members 11 to be pressed to the sheet material P by pressing springs 12. A pressing force of the sheet material pressers 6 and 7 is determined according to a thickness of the sheet material P or the like, but is 1 N (100 gf) in Embodiment 1.

The abnormality sensing unit for sensing abnormality of the sheet material P includes the sheet material presser 7 which comes into contact with the sheet material P to be displaced, and the push-in sensing unit 8 which senses that the sheet material presser 7 is pushed in by the sheet material P. The abnormality sensing unit is illustrated in detail in FIGS. 3. FIG. 3A illustrates a normal case. FIG. 3B schematically illustrates, as an example of an abnormal case, a state where the sheet material is folded due to clogging at the clogging unit.

The sheet material P is transported when being pressed by the displacement member 11 and a pressing spring 12 toward the sheet material support unit 17. In the normal state, due to the pressing pressure, the sheet material P is transported in a state where a shaft 14 and a contact point 16 of a switch 15 do not come into contact with each other. However, when the displacement member 11 is pushed up by the sheet material P in which folding is caused due to sheet clogging at the time of abnormality, the shaft 14 and the contact point 16 come into contact with each other, and abnormality sensing is performed by sensing the contact.

The sheet material support member 17 has a first function of sandwiching the sheet material between the sheet material pressers 6 and 7 and itself as an opposing member. The sheet material support member 17 has a second function of imparting certain deflection to the sheet material in order to accurately obtain information related to the deflection of the sheet material. The sheet material support member 17 further has a third function of preventing the sheet material from causing clogging or being damaged by entering a recess (groove) at the time of transporting the sheet material in a case where the external force detection unit 2 is provided in the recess formed in the sheet material transport path.

As illustrated in FIG. 3A, the displacement member 11 is mounted on the shaft 14 which can be vertically moved by a bearing 13, and is pressed downwardly by the pressing spring 12 arranged between the bearing 13 and the displacement member 11. The push-in sensing unit 8 has a structure in which the contact point 16 of the switch 15 detects an upper end of the shaft 14 raised as illustrated in FIG. 3B. The sheet material support member 17 is fixed to the lower transport guide 9, and the switch 15 is fixed to the upper transport guide 9.

Except for presence/absence of the switch 15, the sheet material presser 7 is made of the same material, and has the same shape as the sheet material presser 6. Note that, a pressing force of the sheet material presser 7 is a little smaller value than that of the sheet material presser 6 on the downstream side, thereby being 0.8 N (80 gf). The shaft 14 connected to the displacement member 11 is supported by the direct-acting bearing 13 so as to be freely movable in a vertical direction of FIGS. 3A and 3B in a predetermined range. The displacement member 11 is pressed by the pressing spring 12 to the sheet material P transported between the upper and lower transport guides 9.

As illustrated in FIG. 3A, the sheet material P is transported while receiving the pressing force toward the sheet material support member 17 by the displacement member 11 and the pressing spring 12. In a normal state, the sheet material P is transported in a state where the contact point 16 of the switch 15 and the shaft 14 do not come into contact with each other.

However, as illustrated in FIG. 3B, when the displacement member 11 is pushed up by the sheet material P in which abnormality such as folding due to sheet clogging is caused, the shaft 14 and the contact point 16 come into contact with each other, thereby allowing the switch 15 to be turned on. The control circuit 121 detects the output of the switch 15, to thereby perform abnormality sensing. In Embodiment 1 of the present invention, a microswitch is used as the switch 15, and when there does not exist the sheet material P, the displacement member 11 is in a retained state where the displacement member 11 is brought into contact with the sheet material support member 17.

When, in the retained state, the sheet material P pushes up the displacement member 11 by a certain distance (0.7 mm) or more, the shaft 14 and the contact point 16 come into contact with each other, thereby allowing the switch 15 to be turned on. When the switch 15 is turned on, the control circuit 121 determines that the state of the sheet material P is abnormal. When a pushed amount of the displacement member 11 by the sheet material P is less than 0.7 mm, the switch 15 is kept in an off state, and the control circuit 121 determines that the state thereof is normal.

A state of the sheet material P, which is determined to be abnormal by the control circuit 121, is a state where at least a part of the transported sheet material P is bent, folded, or damaged, two or more sheet materials P overlap each other, or a sheet material having unexpected thickness or material is fed. When, by the sheet material P transported between the transport guides 9, the displacement member 11 is pushed up or is flipped up to undergo displacement of certain conditions, the control circuit 121 determines that the state is abnormal.

Determination results of the control circuit 121 are transmitted to the control unit 120 of the image forming apparatus 300 (FIG. 1). Further, when the control circuit 121 senses the abnormality, the control circuit 121 immediately makes the motor 3 rotate at high speed to allow the external force application unit 1 to be retracted to the retraction position. Components of the sheet material information detection apparatus 100 are, as illustrated in FIG. 1, provided in the transport path 10 for the sheet material P and are fixed to at least one of the transport guides 9.

With reference to a flow chart of FIG. 4, an operation (sheet material information detection method) of the sheet material information detection apparatus 100 according to Embodiment 1 of the present invention will be described.

As illustrated in FIG. 4, an operation of the sheet material information detection apparatus is started (S11). The operation thereof is started in response to starting of a sheet material processing operation in the image forming apparatus 300 on which the sheet material information detection apparatus 100 is mounted.

Subsequently, in the control circuit 121 for the sheet material information detection apparatus 100, sheet material transport information is input (S12). The sheet material transport information is information related to a position or a speed of the sheet material P, and indicates a timing at which the sheet material P passes through the sheet material information detection apparatus 100. According to the sheet material transport information, a timing of driving (external force application or the like) of the sheet material information detection apparatus 100 is determined. The sheet material transport information has a form of, for example, a signal of the sheet material passage sensor (not shown) of the sheet material information detection apparatus 100 or a signal obtained by processing information related to an operation start (operation in which a copy button is pressed, or the like) of the sheet material information detection apparatus 100.

Subsequently, when receiving the sheet material transport information, the control circuit 121 starts the operation of the sheet material information detection apparatus 100 (S13). As the operation of sheet material information detection, the control circuit 121 performs the abnormality sensing of the sheet material (S14). The control circuit 121 determines that, when the switch 15 is in an on state, the state is abnormal. Note that, in order to prevent an erroneous operation due to vibration or flipping up of a leading end of the sheet material at a time of passage thereof, in a case where the on state satisfies certain conditions, it is determined that the state is abnormal (YES in S14). An example of the certain conditions is conditions in which the switch 15 is kept in the on state for a predetermined time period. As a result, the control circuit 121 can determine a case, where the sheet materials P are double-fed or a loop thereof becomes too large, to be abnormal.

Another example of the certain conditions includes conditions in which a predetermined times or more of the on states are recognized in a certain time period. In this example, the abnormality can be sensed when vibration is caused because the sheet material is folded or wrinkled. In Embodiment 1, in a case where, during a time period in which the sheet material P passes through a position of the sheet material information detection apparatus 100, the on state of the switch 15 is kept for 0.01 or more seconds, the control circuit 121 determines the state as YES (abnormal). In a case where, even after 0.1 or more seconds have elapsed from a time point at which the leading edge of the sheet material P passes a position of the sheet material presser 7, the switch 15 is not turned on, the control circuit 121 determines the state as NO (normal).

In the case of YES (abnormal), the external force application unit 1 is retracted upwardly (S19). In Embodiment 1, when the cam 4 is at any rotation position, the control circuit 121 immediately allows the motor 3 to rotate at high speed, to thereby lift the external force application unit 1 to a highest retraction position for retraction. The control circuit 121 performs an abnormality information output indicating that the sheet material P is in the abnormal state with respect to the control unit 120.

In the case of NO (normal), the control circuit 121 allows the motor 3 to rotate and allows the cam 4 to make the external force application unit 1 strike out, thereby applying an external force to the sheet material P (S15). As a result, the external force detection unit 2 receives the external force of the external force application unit 1 through intermediation of the sheet material. The external force detection unit 2 inputs a voltage signal to the control circuit 121 through the converting unit 123 (S16). The control circuit 121 detects a peak of the voltage signal and outputs the peak to the control unit 120 as the sheet material information (S17). The control unit 120 selects optimum process conditions for image formation according to the sheet material information, thereby performing an appropriate sheet material processing.

As described above, in Embodiment 1 of the present invention, the abnormality of the sheet material P is sensed to retract the external force application unit 1 of the sheet material information detection apparatus 100. According to the control of Embodiment 1, by retracting the external force application unit 1, even in a case where there is abnormality of the sheet material P which is fed, the sheet material P which is transported can be prevented from being caught by the external force application unit 1, or the external force application unit 1 can be prevented from being applied with a strong force. When the jammed sheet material P is removed, the external force application unit 1 is not strained. Thus, a trouble such as breakage of the sheet material information detection apparatus 100 can be avoided.

Embodiment 2

Figure 5A:
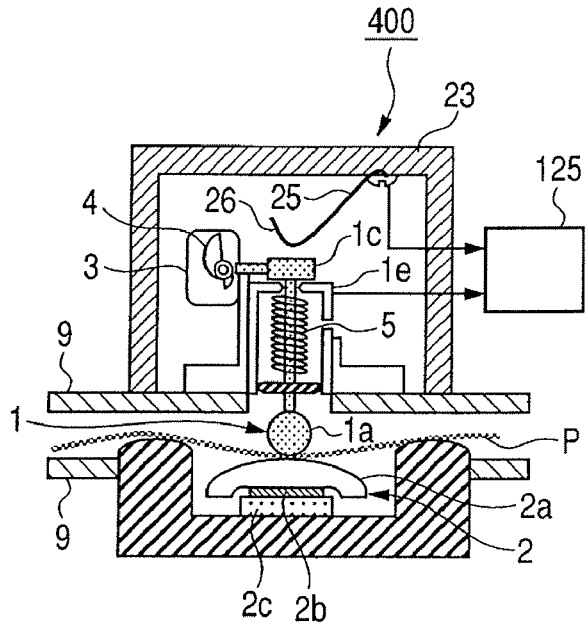
FIGS. 5A, 5B, 5C, and 5D are explanatory diagrams of a structure of a sheet material information detection apparatus according to Embodiment 2 of the present invention.
Figure 5B:
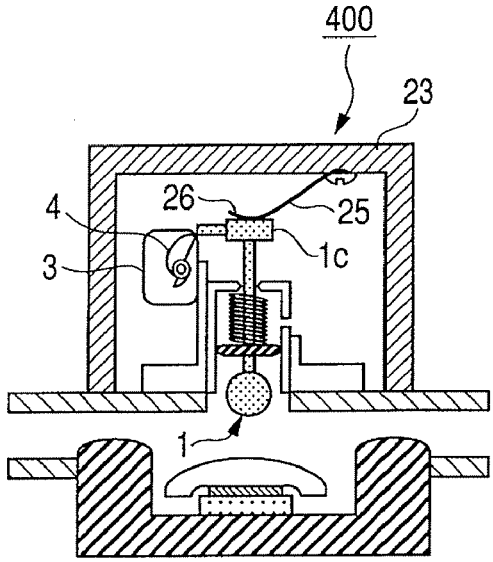
Figure 5C:
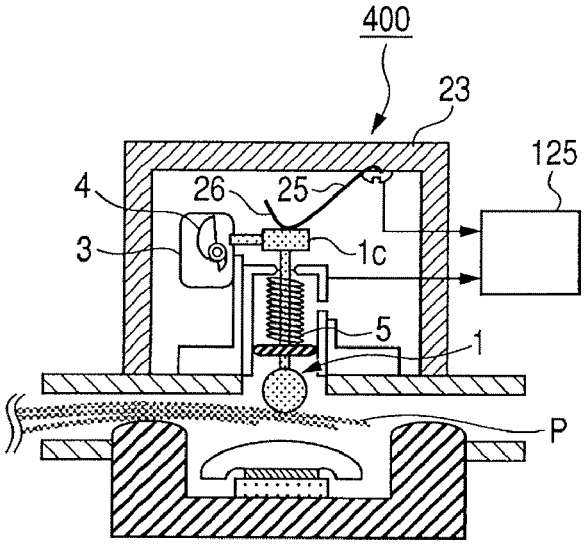
Figure 5D:
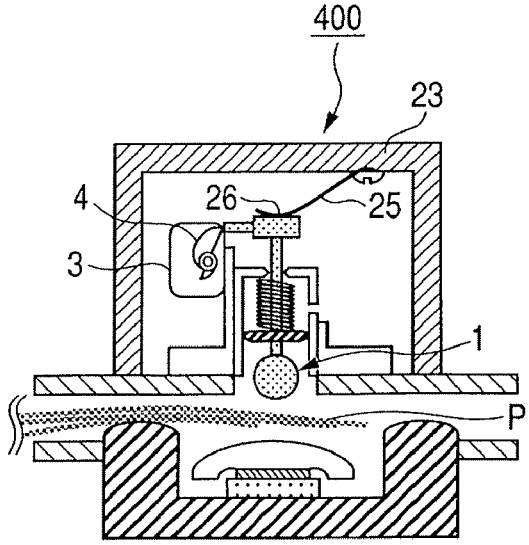

FIGS. 5A to 5D are explanatory diagrams of a structure of a sheet material information detection apparatus according to Embodiment 2 of the present invention. FIG. 5A illustrates a normal state where an external force is applied to a sheet material. FIG. 5B illustrates a state where, in the normal state, an external force application unit is retracted to a retraction position. FIG. 5C illustrates an abnormal state where double-fed sheet materials enter at the time of external force application. FIG. 5D illustrates a state where from the abnormal state of FIG. 5C, the external force application unit is retracted to the retraction position. A sheet material information detection apparatus 400 according to Embodiment 2 of the present invention is provided in place of the sheet material information detection apparatus 100 of the image forming apparatus 300 of FIG. 1. Except for the fact that that the abnormality in conveyance of the sheet material P is detected based on the displacement of the external force application unit 1, the structure is the same as that of Embodiment 1. Accordingly, in FIGS. 5, the same components as those of FIGS. 1 and 2 are denoted by the same reference symbols and detailed descriptions thereof are omitted.

As illustrated in FIG. 5A, the sheet material information detection apparatus 400 of Embodiment 2 of the present invention has a structure in which pushing up of the external force application unit 1 by an abnormal contact with the sheet material is electrically detected by a contact point 26, and a control circuit 125 determines abnormality. That is, the control circuit 125 determines the abnormality when, during a driving period of the external force application unit, the contact point 26 and the external force application unit come into contact with each other at a timing at which those do not come into contact with each other in the normal state.

The shaft 1*b* of the external force application unit 1 is supported so as to be movable in a direction of the shaft by the bearing 1*e*. The external force application unit 1 also serving as the displacement member is pressed downwardly by the spring (pressing spring) 5. The shaft 1*b* of the external force application unit 1 is in conduction with the bearing 1*e* and is insulated from a housing 23 and the transport guides 9. That is, pushing up of the external force application unit 1 by the contact with the sheet material P is detected by the contact point 26. The sheet material P is transported in a state where the sheet material P does not come into contact with the external force application unit 1 or in a state where a excessive pressure is not applied to the external force application unit 1. However, when the external force application unit 1 is flipped up by the sheet material P in the abnormal state, the pin 1*c* and the contact point 26 come into contact with each other, and the control circuit 125 senses the contact, thereby performing the abnormality sensing.

The above-mentioned structure will be described in more detail. A push-in sensing unit 25 is formed of an elastic electrode member. The contact point 26 at a distal end of the push-in sensing unit 25 is set to a high position of a stroke of the pin 1*c* of the external force application unit 1. That is, when the motor 3 rotates the cam 4, the pin 1*c* of the external force application unit 1 does not come into contact with the contact point 26 of the push-in sensing unit 25 except for a certain time period approaching the retraction time, illustrated in FIG. 5B. The control circuit 125 detects conduction between the bearing 1*e* and the housing 23 through the intermediation of the external force application unit 1 and the push-in sensing unit 25, thereby determining abnormality of the transportation of the sheet material P.

For the push-in sensing unit 25 used for the abnormality sensing, a conductive plate spring is used, a distal end unit thereof is bent to constitute the contact point 26, and a proximal end thereof is fixed to the housing 23 by a screw. Further, by wirings (not shown), a unit between the contact point 26 and the pin 1*c* is supplied with an electric potential for allowing electrical sensing of the contact therebetween. It is preferable that a spring constant of the plate spring be set such that a reaction force caused at the time of contact is small enough with respect to a driving force used for the external force application.

The external force application unit 1 as the displacement member is identical in material and shape to the external force application unit 1 of Embodiment 1. The spring 5, the bearing 1*e*, and the shaft 1*b* have the same structures as those of the corresponding members of Embodiment 1. Note that, the wirings for supplying the potential for the electrical sensing of the contact between the external force application unit 1 and the push-in sensing unit 25 are additionally provided.

As illustrated in FIG. 5A, the sheet material P is transported in a state where the sheet material P does not come into contact with the external force application unit 1 as the displacement member in the normal state, or in a state where the excessive pressure is not applied to the external force application unit 1. In those states, there is realized such a driving cycle that, as illustrated in FIG. 5A, at the time of the external force application, the contact point 26 and the shaft unit 1*c* are spaced apart to be non-conductive with each other, and as illustrated in FIG. 5B, at the time of retraction, the contact point 26 and the pin 1*c* are conductive with each other.

However, as illustrated in FIG. 5C, when, by the sheet material P in the abnormal state (in this embodiment, a state where the sheet materials P are triple-fed to be increased in thickness and rigidity is taken as an example), the external force application unit 1 as the displacement member is pushed up, the pin 1*c* and the contact point 26 come into contact with each other. In this manner, when the conduction is detected at a timing at which the pin 1*c* and the contact point 26 are non-conductive in the normal state, the control circuit 125 performs the abnormality sensing. In response to the abnormality sensing, in the control circuit 125, the control circuit 125 drives the motor 3 and the cam 4, and allows the external force application unit 1 to be forcedly retracted to the retraction position illustrated in FIG. 5D. Note that, a rotation direction of the cam 4 is a counterclockwise direction of FIG. 5D.

The above descriptions are outlines of the structure and the operation of this embodiment. In Embodiment 2 of the present invention, when the external force application unit 1 is flipped up to be displaced by the sheet material P, the contact point 26 is in the on state. A range in which the contact point 26 is in the on state is set to be a range from the retraction position to a position spaced apart therefrom by 0.5 mm or less.

Further, in Embodiment 2, when, during a time period in which the sheet material P passes through the sheet material information detection apparatus 400 (at a timing at which the contact point 26 and the external force application unit 1 do not come into contact with each other in the normal state), the sheet material P is flipped up even once, the control circuit 125 immediately determines that there is the abnormality of the transportation. However, after that, in a case where the jam is not caused, and it is confirmed by a sensor (not shown) that the sheet material P has passed through the sheet material information detection apparatus 400, the control circuit 125 determines that the state has returned to the normal state.

A state of the sheet material P detected to be abnormal in Embodiment 2 is the same as Embodiment 1. When the transported sheet material P pushes up or flips up the external force application unit 1 to allow the external force application unit 1 to be displaced by a certain amount or more, the control circuit 125 determines this as the abnormality. In Embodiment 2, in particular, direct impact of the sheet material P with respect to the external force application unit 1 is detected, so the trouble of breakage of the external force application unit 1 can more effectively be avoided.

Embodiment 3

Figure 6B:
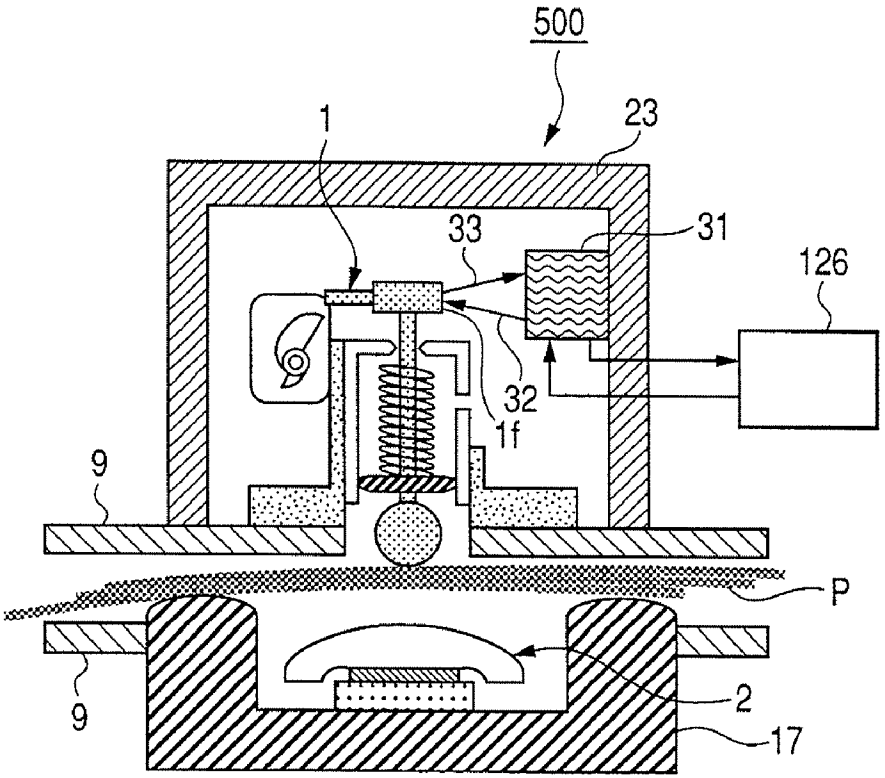
FIGS. 6A and 6B are explanatory diagrams of a structure of a sheet material information detection apparatus according to Embodiment 3 of the present invention.
Figure 6A:
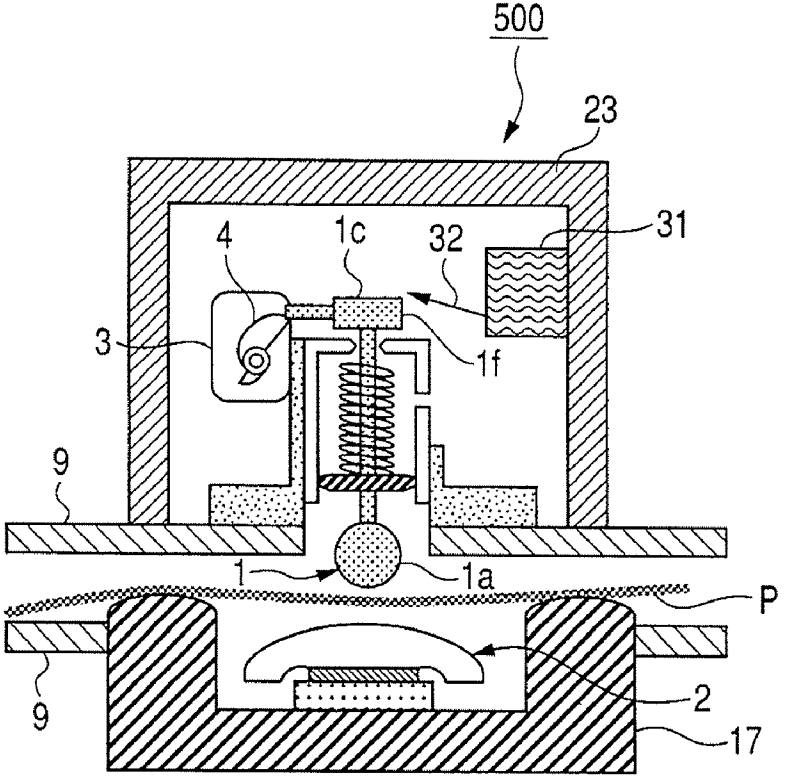

FIGS. 6A and 6B are explanatory diagrams of a structure of a sheet material information detection apparatus of Embodiment 3 of the present invention. FIG. 6A illustrates a normal case. FIG. 6B schematically illustrates a state where sheet materials are double-fed to be overlapped in a particular position as an example of an abnormal case. A sheet material information detection apparatus 500 of Embodiment 3 of the present invention determines the abnormality by detecting a height of the external force application unit 1 as the displacement member as in Embodiment 2 of the present invention. Note that, as a method of detecting the height of the external force application unit 1, a reflective optical sensor 31 is adopted. Except for adopting the reflective optical sensor 31, the sheet material information detection apparatus has the same structure as that of Embodiment 2. Therefore, in FIGS. 6A and 6B, the same components as those of FIGS. 5A to 5D are denoted by the same reference symbols and detailed descriptions of those will be omitted.

As illustrated in FIG. 6A, Embodiment 3 of the present invention provides an example in which, as in Embodiment 2, the abnormality sensing unit is provided to the external force application unit 1, and the abnormality sensing is performed by an optical portion. When the external force application unit 1 as the displacement member is pushed by coming into contact with the sheet material P, the external force application unit 1 is detected by the optical sensor 31.

The external force application unit 1 as the displacement member which is displaced by coming into contact with the sheet material P is provided with a mirror surface if on a side surface of the shaft unit 1*c*. The external force application unit 1 is pushed up by the cam 4 against downward bias by the spring (pressing spring) 5 and is released to be allowed to strike out toward the sheet material P. The external force detection unit 2 receives, through the intermediation of the sheet material P, the external force application unit 1 which is allowed to strike out, and outputs the voltage signal reflecting mechanical property and a moisture amount of the sheet material through the converting unit 123 (FIG. 2). A control circuit 126 detects the peak of the voltage signal to output the sheet material information to the control unit 120 (FIG. 1).

The optical sensor 31 which serves as the push-in sensing unit of the external force application unit 1 includes, as illustrated in FIG. 6B, an LED light source for emitting an irradiating light 32, a light receiving element for detecting a reflection light 33 from the mirror surface 1*f* of the external force application unit 1, and an optical system such as a lens. The light receiving element of the optical sensor 31 is divided into two to four to be capable of detecting a reflection light amount and a reflection direction. The optical sensor 31 applies the irradiation light 32 to the mirror surface 1*f* attached to the side surface of the external force application unit 1, and detects the reflection light amount and the reflection angle. The control circuit 126 detects an output of the optical sensor 31 to sense a movement of the external force application unit 1. When the external force application unit 1 is lifted to an abnormal height as described in Embodiment 2, the control circuit 126 determines that there is abnormality in the transportation.

As illustrated in FIG. 6A, the sheet material P is transported in a state where the sheet material P does not come into contact with the external force application unit 1 or the excessive pressure is not applied to the external force application unit 1. However, as illustrated in FIG. 6B, when, by the sheet material P in the abnormal state, the external force application unit 1 as the displacement member is pushed up, the reflection light amount and the reflection direction change. The control circuit 126 determines the state as abnormal in a case where one of those values or fluctuations exceeds a threshold value.

As illustrated in FIG. 6B, when the reflection light amount from the mirror surface 1*f* increases and a time in which the reflection light amount exceeds a certain value continues, it is determined that there is pushing up affected by the sheet material P, thus it is determined that there is the abnormality. As another example, when the fluctuations in the reflection light amount and the reflection direction become more conspicuous and it is assumed that the external force application unit 1 as the displacement member vibrates, the determination of the abnormality is made. As still another example, when the reflection light amount and the reflection direction largely fluctuate at an instant, it is determined that there is the flipping up affected by the sheet material P, and there is the abnormality. Based on this determination, the retraction operation or the output of the abnormality information is performed.

Note that, in FIG. 6, the reflective optical sensor 31 is used as the push-in sensing unit. However, also by a method in which a shade flag is attached to the external force application unit 1 and the shade flag is detected by using a transmission-type photo interrupter, the pushing-in of the external force application unit 1 can be detected in the same way. In Embodiment 3, in particular, by detecting that the sheet material P directly impacts the external force application unit 1, the trouble of the breakage of the external force application unit 1 can be avoided more effectively. Further, by using the optical sensor for the push-in sensing, many pieces of information on the pushing up, flipping up, vibration and the like of the external force application unit 1 can accurately be distinguished, thereby enabling to deal with various abnormalities of the sheet material P.

Embodiment 4

Figure 7A:
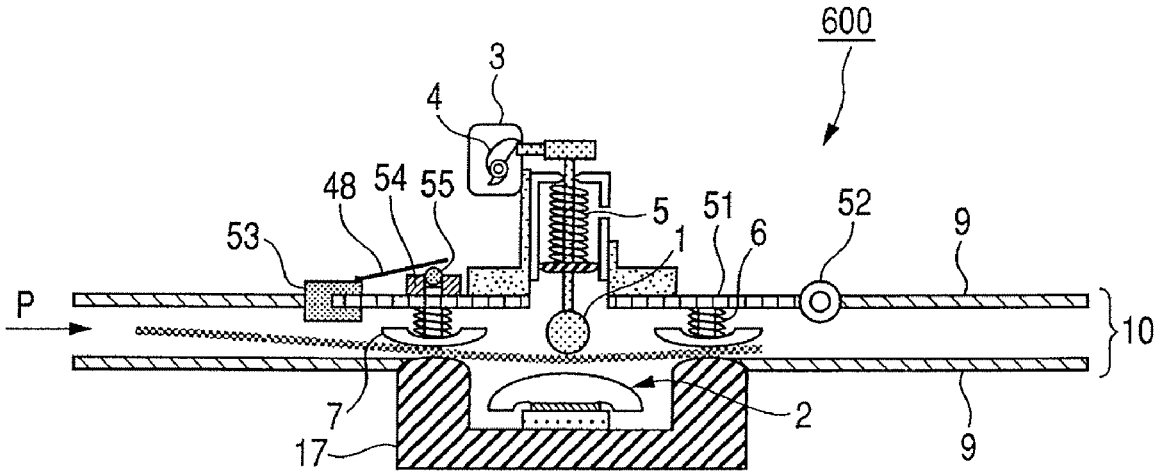
FIGS. 7A and 7B are explanatory diagrams of a structure of a sheet material information detection apparatus according to Embodiment 4 of the present invention.
Figure 7B:
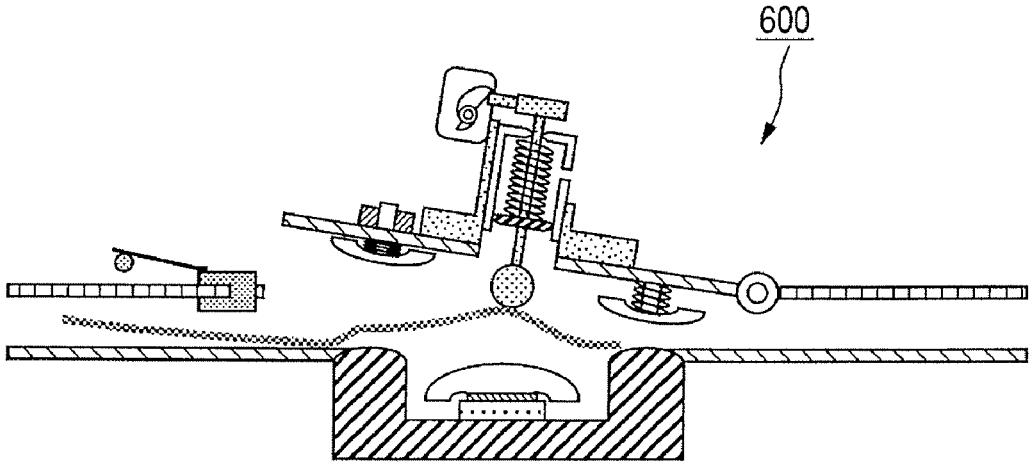

FIGS. 7A and 7B are explanatory diagrams of a structure of a sheet material information detection apparatus according to Embodiment 4 of the present invention. FIG. 7A illustrates a normal case. FIG. 7B schematically illustrates a state where sheet materials are overlapped in a particular position due to sheet clogging as an example of an abnormal case. A sheet material information detection apparatus 600 according to Embodiment 4 of the present invention has a structure in which flapping of the sheet material P is pressed by the sheet material pressers 6 and 7 as in Embodiment 1. Pushing up of the upstream-side sheet material presser 7 by the sheet material P is detected to determine the abnormality. Note that, when the abnormality is detected, an upper structure including a drive mechanism of the external force application unit 1 is largely flipped up, thereby being retracted. Except for a retraction mechanism and a part of a push-up detection mechanism, the structure is the same as that of Embodiment 1. Therefore, in FIGS. 7A and 7B, the same components as those of FIG. 2 are denoted by the same reference symbols, and detailed descriptions thereof will be omitted.

As illustrated in FIG. 7B, according to Embodiment 4, the pushing up affected by the sheet material P is structurally detected, thereby releasing fixation on the external force application side by directly using a push-up force thereof. When the sheet presser 7 is pushed up by the contact with the sheet material P, the external force application side is flipped up largely interlockingly therewith.

As illustrated in FIG. 7A, the external force application unit 1, the motor 3, the cam 4, the spring 5, the sheet material presser 6, and the sheet material presser 7 as the displacement member are mounted onto a fixing plate 51 so as to be assembled integrally therewith. The fixing plate 51 is mounted to the upper transport guide 9 by a hinge 52 containing a coil spring, and is rotatable upwardly, thereby being releasable.

A clip 53 is provided so as to rotate to a side as illustrated in FIG. 7B, and rotates integrally with the push-in sensing unit (plate spring) 48, thereby releasing pressing by the fixing plate 51. The clip 53 has a locking protrusion 55 fixed to a distal end thereof, the locking protrusion 55 being locked in a shaft tube 54, thereby stopping rotation of the clip 53. The shaft 14 (see FIGS. 3) of the sheet material presser 7 protrudes upwardly from the shaft tube 54 to extrude the locking protrusion 55 from the shaft tube 54. When fixation of the fixing plate 51 is released, by the hinge 52 containing the coil spring, the external force application unit 1, the motor 3, the cam 4, the spring 5, the sheet material presser 6, and the sheet material presser 7 are flipped upwardly (direction in which a distance with respect to the sheet material increases), thereby retracting. Note that, for driving the fixing plate, in stead of allowing the hinge to contain the coil spring, there may be used a repulsive force of the spring of the sheet presser. As long as the design allows, a kind of the spring (plate spring, torsion spring, or the like) and a position (upper unit, lower unit, side surface, or the like of the fixing plate) in which the spring is provided can be adjusted.

The external force detection unit 2 arranged so as to be opposed to the external force application unit 1 receives the external force application unit 1 allowed to strike out as illustrated in FIG. 2 through the intermediation of the sheet material P, and generate an output according to mechanical property of the moisture amount of the sheet material P. The external force detection unit 2 is mounted to the transport guide 9. The transport guides 9 are fixed to the image forming apparatus 300 (FIG. 1) as a whole, and the fixing plate 51 placed on the external force application side is mounted to one of the transport guides 9 through the intermediation of the hinge 52 so as to be capable of opening and closing.

In the normal state, as illustrated in FIG. 7A, the fixing plate 51 is locked to the transport guide 9 by the clip 53 at an end of the fixing plate 51, on a side opposed to the end on the side of the hinge 52. The clip 53 rotates in substantially parallel to the fixing plate 51, thereby allowing fixation and releasing of the locking. Further, to the clip 53, an end of the push-in sensing unit (plate spring) 48 is fixed. The other end of the push-in sensing unit (plate spring) 48 is provided with the locking protrusion 55. In the normal state, the locking protrusion 55 is hidden, by a force of the plate spring 48, in a hole of the shaft tube 54 provided on the fixing plate 51 on the external force application side, thereby suppressing rotation of the clip 53, and fixing the clip 53.

However, in the abnormal state, as illustrated in FIG. 7B, the sheet material P lifts the displacement member 7. The locking protrusion 55 is then pushed up by the shaft of the displacement member 7 to be removed from the shaft tube 54.

At the same time, fixation of the clip 53 is released. As a result, the clip 53 horizontally rotates, and at the same time, the fixation between the fixing plate 51 and the transport guide 9 on the external force application side are released. Note that, the rotation of the clip 53 and the rotation of the fixing plate 51 on the external force application side may auxiliary be applied with a rotational force by a coil spring or the like.

In this embodiment, without depending on the control circuit, the motor, the cam, or the optical sensor, the whole mechanism on the external force application side assembled on the fixing plate 51 instantaneously retracts upwardly by a simple mechanical mechanism. Therefore, damage or adjustment deviation in the vicinity of the external force application unit 1 involved in the impact of the sheet material P or the removal of the jammed sheet can be avoided.

Embodiment 5

Figure 8:
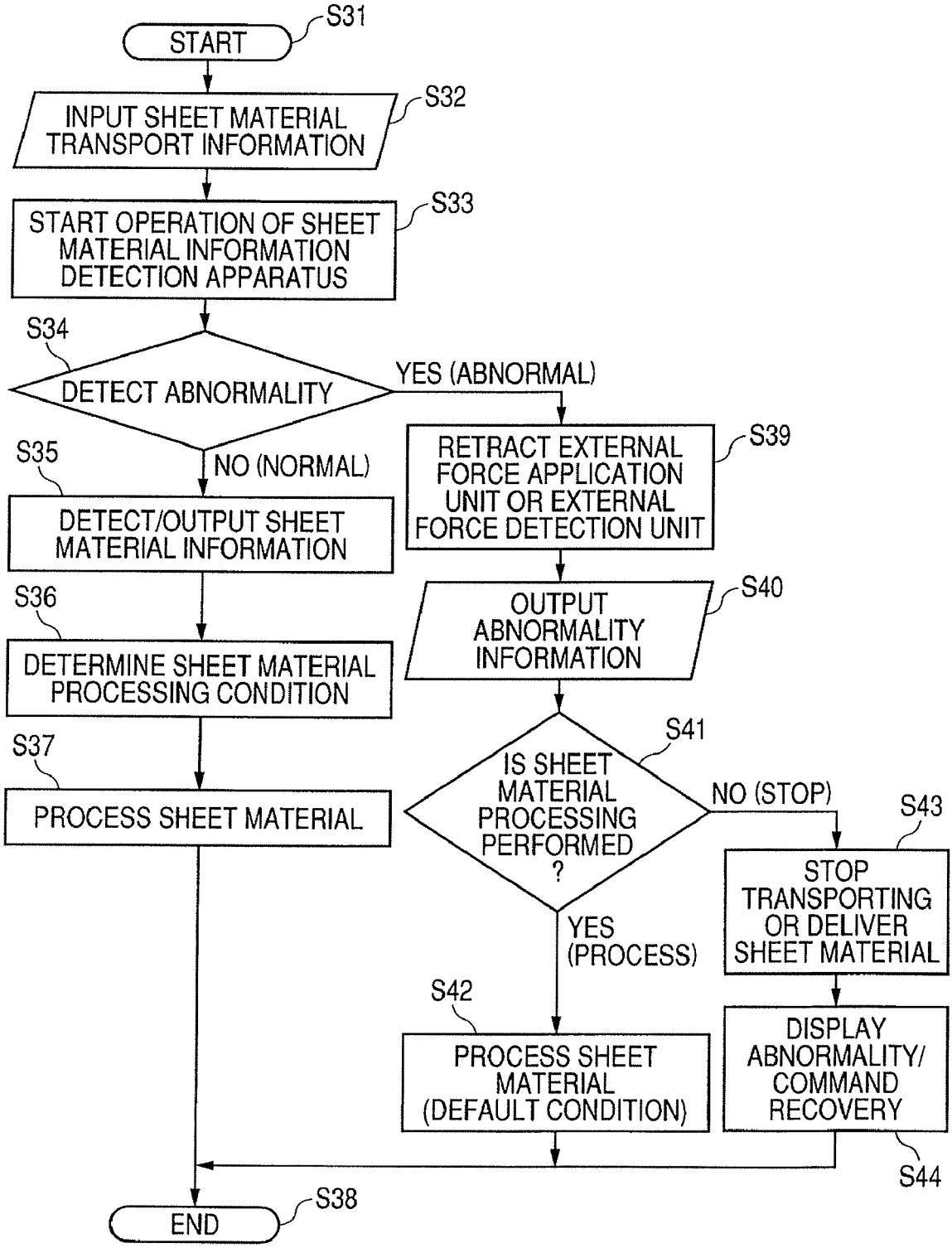
FIG. 8 is a flow chart of a control of an image forming apparatus according to Embodiment 5 of the present invention.

FIG. 8 is a flow chart illustrating a control of an image forming apparatus according to Embodiment 5 of the present invention. In Embodiment 5, a description is made of a control in an abnormal state of the image forming apparatus 300 on which the sheet material information detection apparatus 100 is mounted.

As illustrated in FIG. 8, first, a sheet material processing operation is started to start transportation of the sheet material (S31). The starting of the sheet material processing operation is started by pressing a start button of the main body by a user (operator) of the image forming apparatus 300 or by sending a processing command from peripheral equipment such as an external computer or a camera connected to the image forming apparatus 300. As a result, the operation of the sheet material information detection apparatus 100 is started. The starting is performed, in the image forming apparatus 300 on which the sheet material information detection apparatus 100 is mounted, in response to the starting of the operation of the sheet material processing.

Subsequently, in the control circuit of the sheet material information detection apparatus 100, the sheet material transport information is input (S32). The sheet material transport information is information related to a position or a speed of the sheet material. That is, the sheet material transport information means a timing at which the sheet material passes the position of the sheet material information detection apparatus. Based on the sheet material transport information, a timing for driving the sheet material information detection apparatus 100 (such as external force application) is determined. The sheet material transport information, for example, a signal of the sheet material passage sensor of the image forming apparatus 300 and information including the operation start or the like of the image forming apparatus 300.

Subsequently, by receiving the sheet material transport information, the operation of the sheet material information detection is started (S33).

Subsequently, abnormality sensing of the sheet material is performed (S34). In this abnormality sensing processing, between cases where abnormality is sensed or where abnormality is not sensed, the following flow differs.

First, a description will be made of the case where the abnormality is not sensed (NO in S34). Following the prior item (S34), the sheet material information detection apparatus 100 detects the sheet material information. Subsequently, based on the sheet material information, the sheet material processing conditions are determined (S36). Next, based on the determined sheet material processing conditions, the sheet material processing such as image formation is performed (S37). After the above-mentioned process, the operation ends (S38).

Next, a description will be made of the case where the abnormality is sensed (YES in S34). Following the prior item (S34), the external force application unit 1 of the sheet material information detection apparatus 100 is retracted (S39). Subsequently, the abnormality information is output to the sheet material information detection apparatus 100 (S40).

After that, whether or not the abnormality is released is determined for a predetermined time period (S41). In a case where the sheet material P passes through the sheet material information detection apparatus 100 to release the abnormality (YES in S41), the operation of the sheet material information detection apparatus 100 is stopped and then the sheet material processing is performed under default conditions (S42). In a case where the abnormality is determined to be minor, the sheet material processing is not necessarily stopped.

However, in a case where an effect of the abnormality is assumed to be great, the control unit 120 suspends the sheet material processing. In the suspension of the sheet material processing, the transport of the sheet material is stopped or the sheet material is delivered (No in S41) (S43), and the abnormality of the image forming apparatus 300 is displayed and recovery is commanded appropriately (S44) Further, the control unit 120 determines the effect with respect to the subsequent sheet material processing as needed, and an appropriate processing is performed.

According to the control introduced in Embodiment 5, even in a case where the abnormality occurs in the sheet material information detection apparatus 200, a trouble such as breakage of the sheet material information detection apparatus or members located therearound can be avoided, and an appropriate image forming process can be performed.

Modified Examples

Hereinafter, modified examples of Embodiments 1 to 5 will be described.

Examples of the sheet material may include paper (ordinary paper, glossy paper, coat paper, recycled paper, or the like), a film made of a resin etc, and an OHP sheet, and the sheet material mainly refers to a sheet-like image recording medium. A shape of the sheet material may be any shape such as one obtained by being cut into predetermined dimensions (cut paper) or one rolled in a roll form (roll paper). Further, the sheet material may be a single material or a sheet material obtained by bonding two or more sheet materials to each other. In this description, the description is made of the sheet material cut into predetermined dimensions as an example.

The sheet material information includes all the information related to the sheet material required for the sheet material processing. Particularly important elements include the physical property and shape, and various pieces of information related thereto. The various pieces of information include at least one of the following: a thickness of the sheet material, density, elastic modulus, viscosity, vibration characteristic, irregularity, surface roughness, state, deformation state, strength, easiness of elastic deformation and plastic deformation, stretch amount, color tone, color change, and reflectance. deformation (stretching, bending, crushing, damaging, folding, etc.), transmittance, state of curling, permeability of a gas or a liquid, thermal property such as heat diffusivity or heat capacity may also be included. In a case of using paper, the examples of information include information on irregularity of fibers, a filler amount, a coat layer, or the like. A water content gives a great effect to physical characteristics and a shape of the sheet material, so the water content is a particularly important attribute.

Another important sheet material information is information on an embedded component affecting the physical property. A list of examples of the embedded component includes elements such as an ID tag and natural objects such as pressed flowers and leaves. The other examples of the important sheet material information include information on an image which has been formed, adhesion of a foreign substance, dirt, a size and shape of media, a fold at an end unit or the like, a working state such as cutting or drilling, lamination or coating, adhesion of a staple, or the like. Further, there are also other examples of the important information including bonding of some pieces of media to each other in an in-plane direction, and whether or not two or more of them entirely or partially overlap each other.

Examples of the abnormality of the sheet material P include sheet clogging, double-feeding, and feeding of the sheet material of an unexpected thickness or material. The examples include the bending and clogging (hereinafter, referred to as sheet clogging) of the sheet material P, transportation in a state where the plurality of sheet materials P overlap each other (double-feeding), and feeding of the sheet material P of an unexpected thickness or material. In a case where there is the above-mentioned abnormality of the sheet material P, not only accuracy of the sheet material information detection is notably reduced, but also a serious trouble such as damage of the sheet material information detection apparatus 100 or the peripheral members is caused.

The above-mentioned embodiments include the sheet material information detection apparatus for detecting and outputting the sheet material information. In a case where there is abnormality in the sheet material, a part or an entire unit of the sheet material information detection apparatus is retracted. The retraction is to move the part or the entire unit of the sheet material information detection apparatus in a direction in which a distance with respect to the sheet material is enlarged. For a specific example, a distance between the external force application unit and the external force detection unit, which are opposed to each other while sandwiching the transport path for the sheet material, is enlarged. For another example, the external force application unit or the external force detection unit is displaced from the transport path for the sheet material to the outside thereof. For still another example, the fixation of the external force application unit or the external force detection unit is alleviated or released, and when a force is applied from the sheet material, the external force application unit or the external force detection unit can be displaced to the outside of the transport path.

As illustrated in FIG. 2, the sheet material information detection apparatus 100 includes the external force application unit 1 for applying the external force to the sheet material P, the external force detection unit 2 for detecting by the sheet material P the external force applied from the external force application unit 1. Further, the sheet material information detection apparatus 100 has the drive unit for driving the external force application unit 1, the drive unit including, the motor 3, the cam 4, and the spring 5 as an acceleration unit. As necessary, the sheet material presser 6 is provided for suppressing flapping of the sheet material P which is transported. Further, the sheet material information detection apparatus 100 has the abnormality sensing unit for sensing the abnormality of the sheet material P. The abnormality sensing unit includes the sheet material presser 7 as the displacement member which displaces by being brought into contact with the sheet material, and the push-in sensing unit 8 for sensing the push-in of the sheet material presser 7 by the sheet material P.

The above-mentioned components are arranged in the transport path 10 for the sheet material P and are fixed to one of the transport guides 9. Note that, the abnormality sensing unit may partially or entirely be formed of different physical units such as an optical unit and an electrical unit.

In the sheet material information detection apparatus is a method in which an impact force is applied to a sheet material P using an external force application unit 1, and reaction of the sheet material P is received by an external force detection unit 2 and is detected by a pressure-sensitive element 2*b*. As a result, local bending rigidity and compression rigidity can be detected, and mechanical property of the sheet material can be detected.

For the pressure-sensitive element 2*b*, an element capable of detecting pressure or acceleration, such as a piezoelectric element, a piezoresistance element, an electrostatic capacity acceleration sensor, or a magnetic sensor is appropriately used.

For the application of the impact force, the external force application unit 1 of a certain mass is allowed to impact the sheet material P in a state where an appropriate speed and acceleration are maintained. A material, shape, mass, impact speed, and acceleration of the external force application unit 1 are appropriately determined according to a type and range of the sheet material P as an object of detection. Desirable examples of paper for use in a copying machine used for detection include ordinary paper, coat paper, bond paper, recycled paper, and resin sheets such as OHP.

The desirable material and shape of the external force application unit 1 are those causing minimum wear due to impacting with the sheet material P or contacting involved therein, and minimum plastic deformation and elastic deformation, and having high toughness and causes no crack. Specifically, as the material, a metal material such as stainless steel is desirably used. As the shape, a spherical shape or a bar shape is desirable, and a distal end portion thereof impacting the sheet material P desirably has a curved surface. By providing the curved surface, even in a case where an impact angle is changed due to vibration of the external force application unit or sheet material P at the time of impact, stable impact application is possible, and local wear is reduced, so an even impact application is realized. A part of the curved surface may be provided with a flat portion. By allowing the flat portion to impact the sheet material, the sheet material at an impact portion is evenly compressed, so an error resulting from unevenness of the sheet material can be reduced.

The mass, the impact speed, and the acceleration of the external force application unit 1 is appropriately determined in consideration to rigidity of the sheet material within a range in which the external force application unit 1 does not leave impression or the like on the sheet material P. A desirable range for the detection of the sheet material (paper) for use in the image forming apparatus 300 is mass of about 1 g to 10 g and impact speed of about 0.1 m/sec to 1 m/sec.

Further, the acceleration at the time of impact is desired to be as small as possible. This is because, even in a case where a moving distance until the external force application unit 1 impacts the sheet material depending on dispersion in thickness of the sheet materials P, fixation accuracy of the sheet material information detection apparatus 100, or the like, the impacting at a stable speed can be realized. While depending on the impact speed, variation in speed of the acceleration is desirably within a range of 5% or less, more desirably, 1% or less for the moving distance of 1 mm. In order to reduce the acceleration, acceleration caused by an acceleration unit, acceleration/deceleration caused by the gravity, and deceleration due to resistance caused by friction or the like are used while appropriately compensating for one another.

The application of the external force through the impact may be performed once or a plurality of times for one time of sheet material information detection. Further, the application may be performed in a plurality of positions at the same time, or may be performed intermittently. In a case where the plurality of times of impact application is performed, it is desirable that by applying impact forces of the same value, the output value be equalized to enhance the accuracy. Further, by applying the impact forces of different values to a single sheet material, a plurality of physical property values of the sheet material can be detected.

There may be provided a mechanism for deflecting or compressing the sheet material P by the external force application. For the mechanism for deflecting the sheet material P, in a position opposing the external force application unit 1 through the intermediation of the sheet member P, a step structure such as a groove structure (recess structure) is provided. For the mechanism for compressing the sheet material P, in a position opposing the external force application unit 1 through the intermediation of the sheet member, an external force receiving member for receiving the external force is provided. The groove structure and the external force receiving member may be integrated to each other, or may be separated from each other.

The sheet material P may be deflected while being supported only at one side or both sides. Further, a part of the sheet surface may be deflected to be a recess. Note that, in a case where, as disclosed in Japanese Patent Application Laid-Open No. 2005-024550, an external force detection mechanism is directly connected to the external force application unit to detect a repulsive force of the sheet material P, the external force receiving member is not necessarily required.

The sheet material has elasticity and flexibility, so displacement according to mechanical property of the sheet material P is caused by the impact force when impact force is impressed. The displacement of the sheet material P is measured by the displacement detection element, and mechanical property of the sheet material P can be detected from a displacement amount, displacement speed, and acceleration of the sheet material. As the displacement detection element, the pressure-sensitive element 2*b* as described above may be used.

The pressure-sensitive element 2*b* is bonded to a mechanical displacement member (plate-spring like cantilever or the like) to be brought into contact with the sheet material P, so the displacement can be measured from the output of the pressure-sensitive element 2*b*. As a matter of course, the displacement of the sheet material P may be measured from transmittance and reflection of light, sound, or the like without mechanical contact by applying the light, sound, or the like to the sheet material P by an optical element, an acoustic element, or the like.

Vibration is applied to the sheet material P, and detection may be performed by the pressure-sensitive element. A reaction from the medium when the vibration is applied to the sheet material is detected by the pressure-sensitive element. For example, the sheet material P is sandwiched between the external force application unit generating vibration and the external force detection unit formed of the pressure-sensitive element, and the vibration is applied to the sheet material P by the external force application unit, and the vibration is detected by the external force detection unit through the sheet material. As a result, attenuation, change in phase, transmission time, and the like of the vibration of the sheet material P are measured to detect mechanical property of the sheet material P. There may be employed various arrangement relationships between the external force application unit and the external force detection unit, and the sheet material P.

In addition, a force of vibration or a frictional force may be detected by applying a transport force as the external force and rubbing a surface of media with a probe. Alternatively, property may be detected by imparting a wave motion such as light or acoustic wave, and detecting a wave motion after reflection or transmission.

The abnormality sensing unit for sensing the abnormality of the sheet material P which is transported detects the case of sheet clogging, double-feeding, feeding of the sheet material of an unexpected thickness or material, or the like. The push-in of the displacement member 11 in a suppression detection unit may be sensed through electrical conduction detection or mechanical pressing detection. Further, the push-in sensing may be performed by an optical detection element (for example, photointerrupter). The detection may be of a contact type as described in Embodiment 2 or a non-contact type.

When the abnormal displacement of the displacement member is detected by the suppression detection unit, the external force application unit or at least a part of the external force detection unit is retracted from the sheet material P interlockingly therewith. The retraction herein means to move the external force application unit or at least a part of the external force detection unit in a direction in which a distance between the external force application unit or at least a part of the external force detection unit, and the sheet material P which are opposed to each other enlarges. The movement may actively be performed by using a driving force, or may passively be performed by releasing the fixation upon application of a force from the sheet material P.

The interlock between the detection of displacement of the displacement member and the retraction movement may electrically be controlled. For example, the abnormality is detected by the electrical conduction detection, and a conduction signal is transmitted to a motor control system to operate a motor, thereby allowing the external force application unit to be retracted to the retraction position. The retraction position in Embodiments 1 and 2 corresponds to a position where the external force application unit 1 is pulled up to the vicinity of an upper dead center of the cam 4 illustrated in FIG. 2.

The interlock between the detection of displacement of the displacement member and the retraction movement may mechanically be controlled as described in Embodiment 5. The mechanical control means to release the fixation by driving a releasing mechanism by a suppression force of the displacement member, or the like.

The retraction amount is set to a distance, which does not cause a damage to the sheet material information detection apparatus 100 and the image forming apparatus 300 due to at least passage and impact of the sheet material. Specifically, the retraction is desirably performed to outside a surface of a transport guide 9, which is to be brought into contact with the sheet material P, the transport guide constituting the transport path 10 for the sheet material P. However, in a case where there is provided a mechanism for dissipating a pressure due to the contact with the sheet material P, such as a case where a surface of the member of the sheet material information detection apparatus 100 to be retracted, which is adjacent to the sheet material P, is structured to be a curved surface, protruding of the curved surface into the transport path may not be a problem.

Recovery from the retraction position may automatically be performed. Alternatively, the recovery may actively be performed through a resetting operation by a user or may manually be performed.

In Embodiment 1, the description is made of the image forming apparatus 300. However the sheet material processing apparatus of the present invention is not limited to the image forming apparatus. The image forming apparatus includes an apparatus for recording characters, images, or the like on a sheet material. Among current representative image forming apparatuses, that is, a copying machine, a laser beam printer, and an ink jet printer, there is generally provided a sheet material processing apparatus having a structure in which, as a part of a process, sorting, punching, or stapling for book binding, curl correction, stacking, or the like. As described above, an object of the present invention is aimed at an entire process performed until the medium which is set is discharged from the image forming apparatus 300.

Further, another example of the sheet material processing according to the present invention is to read a content recorded on the sheet material. The content recorded on the sheet material may be of any type or form, including images or characters, stamps, magnetically-recorded data, and data recorded on an embedded element.

Further, other examples of the sheet material processing apparatus of the present invention include an apparatus for transporting a sheet material and reading information recorded on the sheet material (such as so-called document scanner), a feeder apparatus for paper money, tickets, or the like, an apparatus for performing machining such as folding, punching, or the like of the sheet material.

In the image forming apparatus serving as a processing unit, processing conditions for the sheet material P are changed, adjusted, or controlled based on the sheet material information obtained by the sheet material information detection apparatus. An example of the processing conditions include image forming conditions related to transferring of colorant to the medium, the colorant mainly being toner in a case of an electrophotographic printer, and mainly being ink in a case of an ink jet printer. In the image forming apparatus, the image forming conditions are adjusted by changing the image forming conditions or control conditions for the image formation based on the sheet material information.

For example, on the sheet material P having a small thickness, images are formed in a mode suitable for a thin sheet, and on the sheet material P having a large thickness, images are formed in a mode suitable for a thick sheet. For controlling image forming conditions, it is preferable that, first, a transfer amount of the colorant be adjusted. Examples of the transfer amount include a supplying amount of the toner, an adhesion amount of the ink, and the like with respect to the medium. It is preferable that, second, fixing conditions for the colorant be adjusted. Examples of the fixing conditions include a fixing temperature, a fixing pressure, and the like.

Note that, the adjustment of the sheet material processing conditions is not limited to adjustment of arrangement of the images, and adjustment of transfer conditions for the colorant described above. The adjustment of the sheet material processing conditions is performed by a computer control apparatus (processor) for determining the operation of the sheet material processing apparatus by processing input data. The computer control apparatus may be provided in the image forming apparatus 300 or a function thereof may be left to an external computer or the like.

The sheet material processing apparatus according to the present invention can be provided with a processing function dealing with the abnormality of the sheet material P. Specifically, there can be provided a mechanism for manually pulling out the sheet material P from the transport path by releasing the fixation of the components.

In the sheet material information detection apparatus according to the present invention, the sensed abnormality of the sheet material P can be transmitted to the sheet material processing apparatus as one piece of the sheet material information, and a proper processing can be performed therefor. Examples of the processing include, as described in Embodiment 5, stopping of a transport force, shift of various sheet material processing processes to a stopping state, issuing of an alarm, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-178770, filed Jun. 28, 2006, which is hereby incorporated by reference herein in its entirety.

What is claimed is:

1. A sheet material information detection apparatus comprising:

an impact force application unit for applying an impact force to a sheet material;

an impact force detection unit for detecting the impact force applied by the impact force application unit;

an abnormality sensing unit for sensing abnormality of the sheet material entering a space between the impact force application unit and the impact force detection unit; and a retraction unit for allowing at least one of the impact force application unit and the impact force detection unit to retract in a direction in which the at least one of the impact force application unit and the impact force detection unit is moved away from one of the sheet material and a transport path for the sheet material in a case where the abnormality sensing unit senses the abnormality, wherein the abnormality sensing unit comprises a sheet material presser unit and a push-in sensing unit for sensing that the sheet material presser unit is pushed in by the sheet material, and the sheet material presser unit supports a displacement member that causes displacement by contact with the sheet material, wherein when a state exists where the sheet material pushes up the displacement member a distance sufficient to close an electrical contact for a first predetermined period of time, or when the sheet material pushes up the displacement member a sufficient amount to close an electrical contact a predetermined number of times in a second predetermined period of time, the abnormality sensing unit determines that the state is abnormal.

2. The sheet material processing apparatus according to claim 1, wherein, in the case where the abnormality sensing unit senses the abnormality, the control unit adjusts the processing conditions in the processing unit based on sheet material information of a fixed value which is prepared in advance in place of the sheet material information detected by the sheet material information detection apparatus.

3. The sheet material information detection apparatus according to claim 1, wherein the distance sufficient to close the electrical contact is 0.7 mm or more and the first predetermined period of time is 0.01 seconds or more.

* * * * *